US006948787B2

(12) United States Patent
McBrayer, III et al.

(10) Patent No.: US 6,948,787 B2
(45) Date of Patent: Sep. 27, 2005

(54) FOLDING WARDROBE WITH INTEGRAL HINGE ASSEMBLY

(75) Inventors: John H. McBrayer, III, San Antonio, TX (US); John H. McBrayer, IV, San Antonio, TX (US)

(73) Assignee: KLN Steel Products Company, Ltd., San Antonio, TX (US)

( * ) Notice: Subject to any disclaimer, the term of this patent is extended or adjusted under 35 U.S.C. 154(b) by 5 days.

(21) Appl. No.: 10/357,742

(22) Filed: Feb. 4, 2003

(65) Prior Publication Data

US 2004/0150302 A1 Aug. 5, 2004

(51) Int. Cl.[7] ..... A47B 43/00
(52) U.S. Cl. ..... 312/258
(58) Field of Search ..... 312/258, 262, 312/257.1; 16/223, 221

(56) References Cited

U.S. PATENT DOCUMENTS

| | | | | | |
|---|---|---|---|---|---|
| 700,237 | A | * | 5/1902 | Randall | 312/205 |
| 889,741 | A | * | 6/1908 | Additon | 312/262 |
| 933,210 | A | * | 9/1909 | Ullom | 217/14 |
| 1,342,269 | A | | 6/1920 | Stewart | |
| 2,934,389 | A | * | 4/1960 | Krey | 312/262 |
| 3,294,464 | A | * | 12/1966 | Lew | 312/258 |
| 6,039,418 | A | * | 3/2000 | Thomas | 312/258 |
| 6,722,750 | B2 | * | 4/2004 | Chan | 312/258 |

FOREIGN PATENT DOCUMENTS

| | | |
|---|---|---|
| GB | 207044 | 11/1923 |
| GB | 492972 | 9/1938 |
| GB | 2368265 | 1/2002 |
| WO | WO 01/37705 | 5/2001 |

* cited by examiner

*Primary Examiner*—Milton Nelson, Jr.
(74) *Attorney, Agent, or Firm*—Jackson Walker, LLP

(57) ABSTRACT

A foldable sheet metal wardrobe having a front wall, a rear wall, a foldable right side wall, a foldable left side wall, a top member, and a bottom member defining an inner wardrobe space when the wardrobe is in an open position. A left and a right unitary front side panel, each of the unitary front side panels has a first section of a closed loop hinge assembly integrally formed in the sheet metal of the front side panel. The first integral hinge section has an offset stiffener member. A left and right unitary rear side panel, each of the unitary rear side panels has a second, complimentary closed loop hinge assembly section integrally formed in the sheet metal of the rear side panels. The second integral hinge section also has an offset stiffener member. Each of the front side and the rear side panels are connected along the first and second sections by a single continuous steel hinge pin to join the sections into single foldable left and right hinged side walls. The wardrobe hinges are stronger and more secure from exposure to unauthorized entry.

6 Claims, 8 Drawing Sheets

FOLDING WARDROBE WITH INTEGRAL HINGE ASSEMBLY

BACKGROUND OF THE INVENTION

This invention relates to furniture and more particularly to folding or collapsible wardrobes and cabinets. Even more specifically, the present invention relates to a sheet metal folding wardrobe having integral hinges formed in the sheet metal composition of the wardrobe or cabinet wherein the hinges are joined by single continuous steel hinge pins.

Folding wardrobes are well known in the art. Typically, these units are made of wooden or plastic composition.

U.S. Pat. No. 1,342,269 illustrates a typical collapsible unit having a front panel with a door opening, a closed back wall, two side panels, a top and a bottom defining an inner wardrobe space. The various walls are hinged together using standard separate, applied hinge members affixed to the walls.

International Publication Number WO 01/37705 A1 discloses a free-standing plastic foldable storage unit. The unit has panels connected by living hinges attached to the panels by hot melt adhesives. In one embodiment disclosed in WO 01/37705 A1, a back wall is formed from a one piece extrusion, preferably made from PVC or polypropylene, and has an adjoining living hinge integrally formed therein along its vertical midline dividing the back into two panels. The living hinge is a thinned linear portion of the plastic material (PVC) formed during the extrusion process. The living hinge is a weakened seam dividing the back wall that allows the wall to fold along this weakened seam or hinge. In a further embodiment, a series of separate integrally molded C-shaped channels and pins make up hinges connecting the back panels to one another. The plastic C-shaped channels are not closed and the assembled hinges are spaced apart. There are a multiplicity of separate hinge pins used.

The present invention is a foldable wardrobe constructed from sheet metal to provide fire resistance and increase inner space security. The hinge sections are continuous and integrally formed by bending or pressing tabs into generally closed loops at the end of offset stiffener sections in the tabs. A single, continuous, steel hinge pin extends through the entire hinge to again increase the security of the unit.

DETAILED DESCRIPTION OF THE PREFERRED EMBODIMENT

Figure 1:
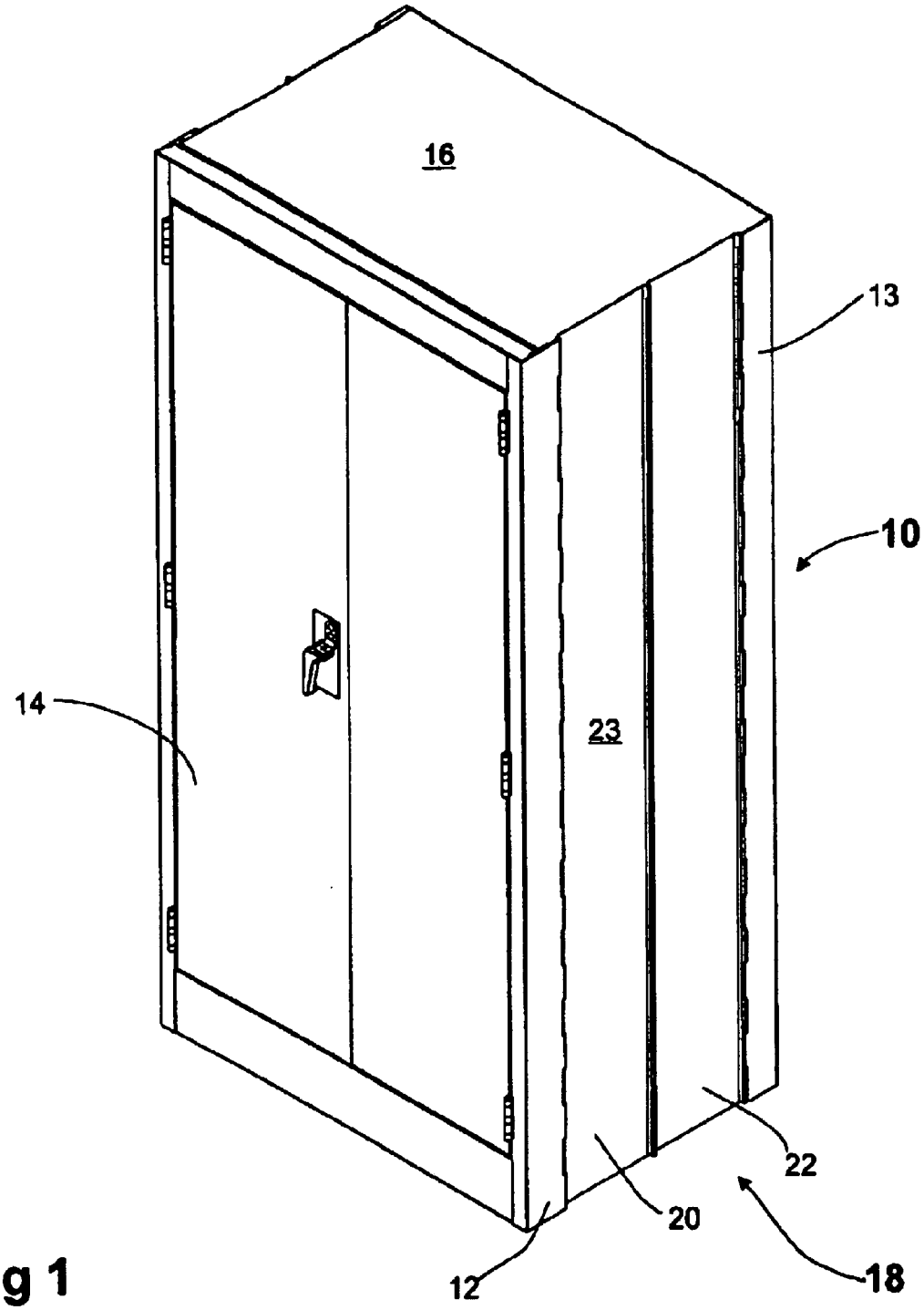
FIG. 1 is a front, top, left side perspective view of one embodiment of the present invention in the open position.

FIG. 1 shows a front left side perspective view of the preset invention 10 illustrating the front and rear frame assemblies 12 and 13, closure doors 14, top panel 16, left side folding panel 18 having left front side panel section 20, and left rear side panel section 22.

It should be understood that there is a right side folding panel (shown in other drawings) and a bottom panel (see FIGS. 3 and 11) which all define an inner wardrobe space when the wardrobe 10 is in the open position shown in FIG. 1.

Side panel sections 20 and 22 are joined together through cooperating hinge elements (see FIG. 5) having a single, continuous steel hinge pin extending the entire length of the side panel 18.

Figure 2:
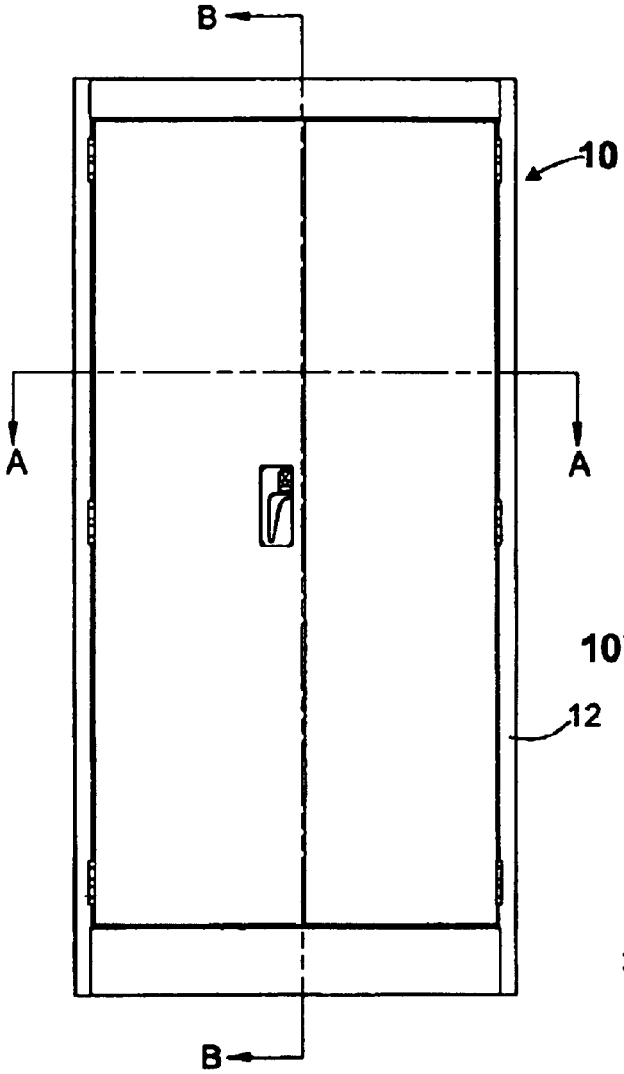
FIG. 2 illustrates a front elevation view of the embodiment of FIG. 1.
Figure 3:
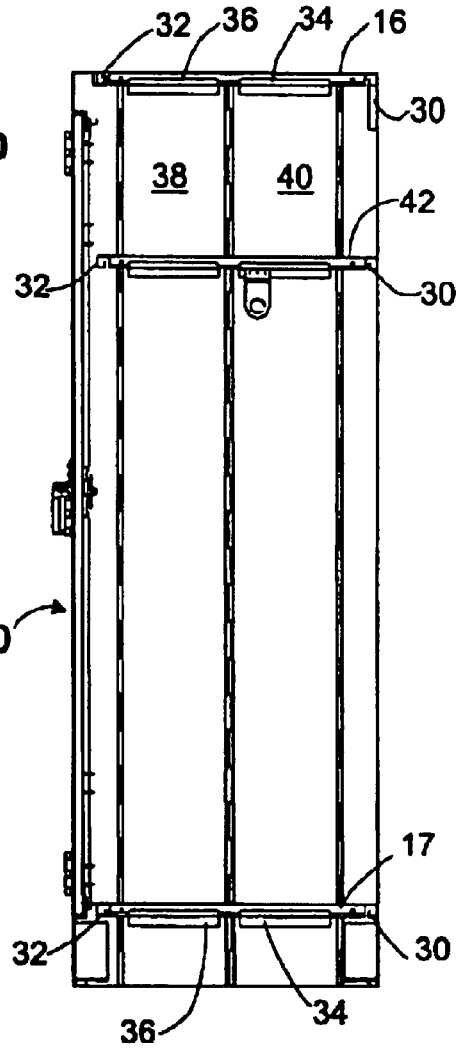
FIG. 3 shows a cross-sectional side view of the present invention taken along line B—B of FIG. 2.

FIG. 2 depicts a front elevation view of the present invention showing the closure doors 14 shut in the front frame 12. FIG. 3 shows a side, cross-sectional view of the wardrobe 10 taken along line B—B of FIG. 2. In FIG. 3 it may be seen that the boundaries defining the inner space of the wardrobe include the top 16 and the bottom 17 which are secured to the front and rear assemblies by shelf channels 30 and 32 on the inside of the rear and front frames. Shelf channels 34 and 36 extending laterally along the inside surface of the front and rear side panel sections further secure the top and bottom panels in the unit. FIG. 3 shows right front side panel 38 having channels 36 at the top and bottom and right rear side panel 40 having channels 34 at the top and bottom. Also illustrated in FIG. 3 is the placement of central shelf or panel 42 similarly secured within the inner space on shelf channels attached to the front and rear frames and the right side panel. Obviously, the left side panel also has shelf channels to support and secure the top, bottom and central panel as would be understood by one skilled in the art.

The particular configuration of the top, bottom, and central panels allow for the fabrication of a single, sized and shaped shelf for use as top, bottom or central panels. This considerably reduces the cost of manufacture.

Figure 4:
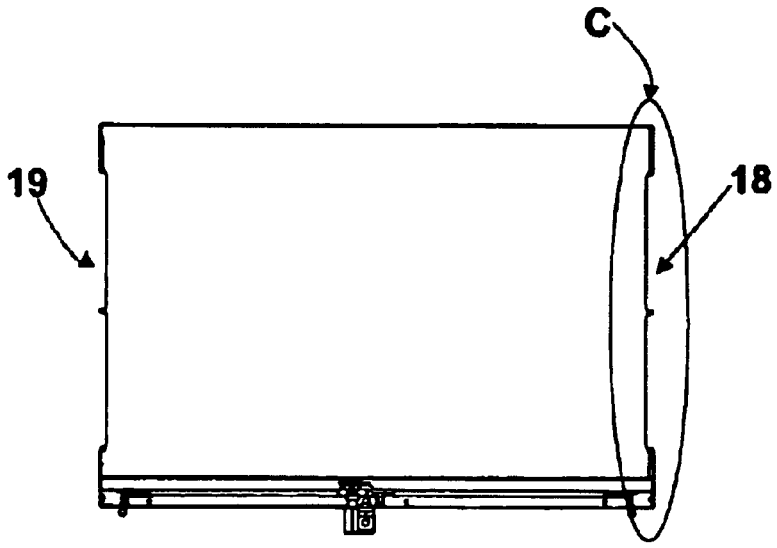
FIG. 4 depicts a top cross-sectional view of the embodiment of FIG. 2 taken along line A—A.
Figure 6:
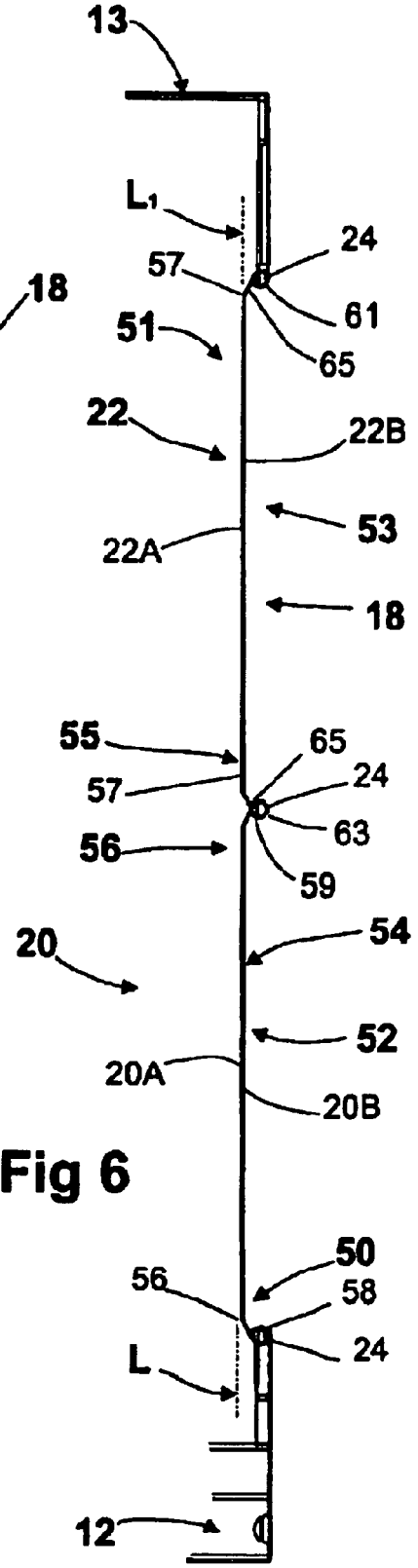
FIG. 6 is a detailed drawing of the foldable left side panel of the present invention taken as a top edge view from the circled portion of FIG. 4.
Figure 5:
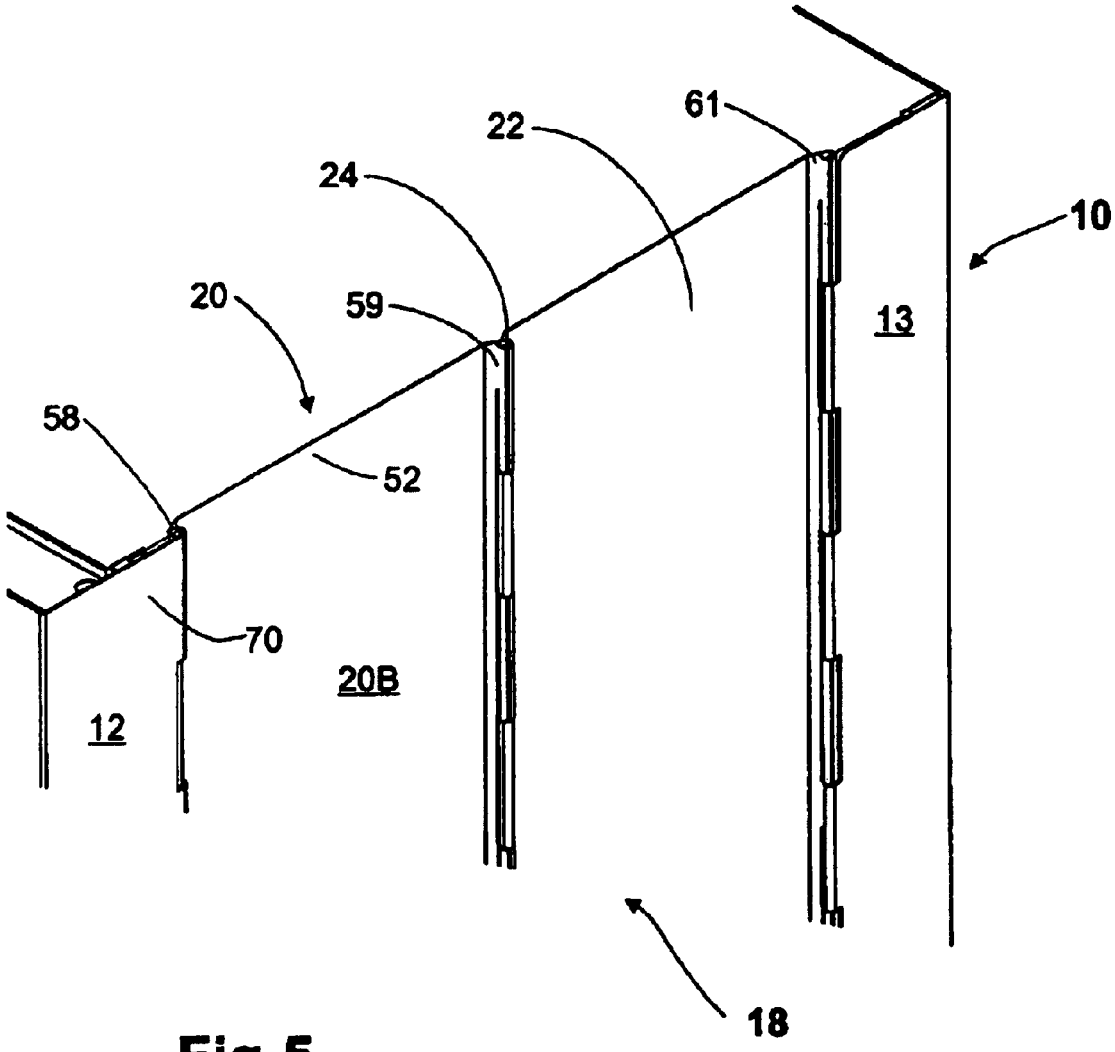
FIG. 5 illustrates a partial, perspective view of the foldable left side panel of the present invention in the open position.

FIG. 4 illustrates a top plan view of the wardrobe 10 without certain details to clarify the arrangement of the foldable side panels 18 and 19. A perspective view of the left side panel 18 is shown in FIG. 5 while detail C of FIG. 4 is shown in FIG. 6. Right and left foldable side panels 18 and 19 are similar in construction. The left side 18 will be described throughout. It will be understood by one skilled in the art that the right side 19 is essentially the same as side 18.

Turning to FIG. 6, it may be seen that left side foldable side panel 18 comprises a unitary left front side panel 20 and a unitary left rear side panel 22. Each panel 20 and 22 has a longitudinal axis L and $L_1$, respectively, used as a reference for describing the relationship of other portions of the panels. Each side panel 20 has an inner surface 20A, an outer surface 20B, a front side panel edge 50, a front side panel midsection 52, a front side panel connection edge 54, and a plurality of cooperating front side panel hinge arms 56. Each of the front side panel hinge arms 56 has approximately a front side panel edge closed hinge eyelet 58 or a front side panel connection edge closed hinge eyelet 59 integrally formed in the sheet metal of the front side panel. The closed eyelets 58 and 59 extend outwardly from the lateral axis L of panel 20 at an angle of 10° and are at the distal end of the hinge arm stiffener 60 (see FIG. 9B). The offset angle of the hinge stiffener section provides a stronger hinge assembly than is achieved by using a straight (0°) hinge arm or a perpendicular (90°) hinge arm. The strength of the hinge assembly provides for greater security from unauthorized entry or vandalism of the wardrobe 10.

In a similar way the rear side panel 22 has an inner surface 22A and an outer surface 22B, a rear side panel edge 51, a rear side panel midsection 53, a rear side panel connection edge 55, and a plurality of cooperating rear side panel hinge arms 57. Each of the rear side panel hinge arms has approximately a rear side panel edge closed hinge eyelet 61 or a rear side panel connection edge closed hinge eyelet 63 integrally formed in the sheet metal of the rear side panel. These eyelets 61 and 63 extend outwardly from the lateral axis $L_1$ of the panel 22 at an angle of 10° and are at the distal end of the hinge arm stiffener 65. The closure of the eyelets by the bending or pressing of the sheet metal of the panel also increases the strength and integrity of the completed hinge assembly. Plastic C-shaped hinges extruded into a panel as described in the prior art are not sufficiently secure to prevent unauthorized entry and are easy targets for vandalism.

Both the front side panel and the rear side panel attach the edge eyelets 58 and 61 to corresponding front frame eyelets 70 and rear frame eyelets 80 (see FIGS. 7A and 8A) with continuous steel hinge pins 24. Connecting hinge eyelets 59 and 63 are hingedly attached by a single, continuous steel hinge pin 24 to form a single foldable left (or right as the case may be) hinged side wall.

Figure 7:
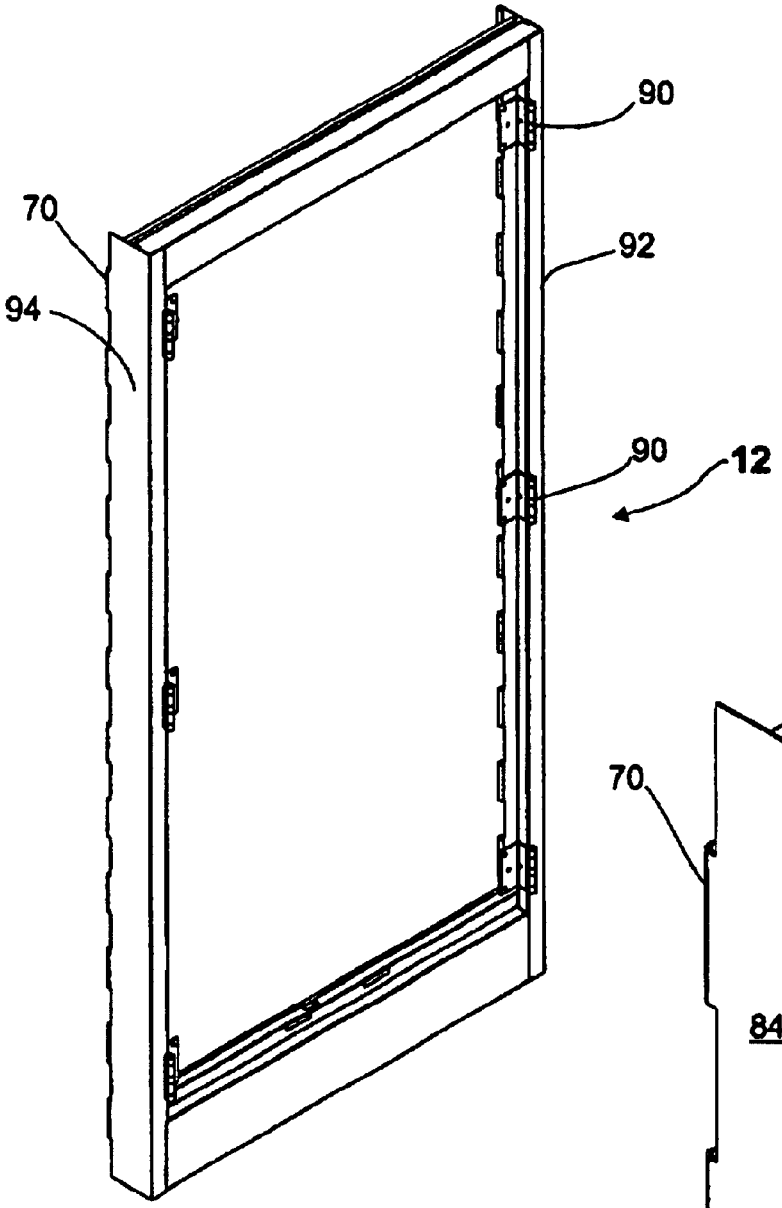
FIG. 7 shows a front perspective view of the front frame assembly of the present invention without closure doors.
Figure 7A:
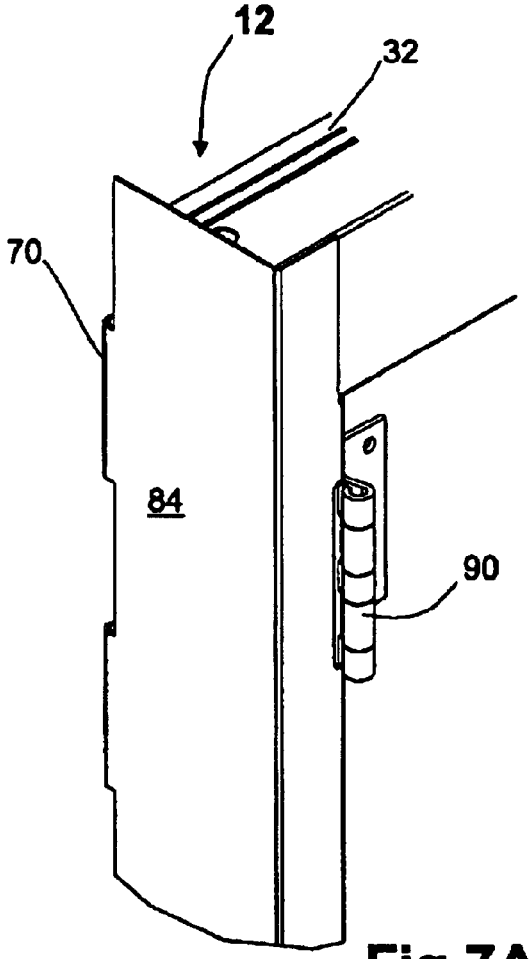
FIG. 7A depicts a detailed right side perspective view of a portion of the front frame assembly of the present invention showing the front hinge eyelets extending inwardly toward the inner space of the unit and rearwardly toward the rear frame assembly.

The front frame 12 is shown in FIG. 7. Conventional door hinges 90 are provided in the side sections 92 and 94 of the frame 12. The frame side wall portions 92 and 94 extend rearwardly toward the rear panel and is provided with a plurality of closed hinge eyelets 70 inwardly extending for cooperative attachment to the closed, offset, outwardly extending front side panel hinge eyelets 58. The inward extension of the eyelets 70 cooperates with the outward extension of the side panel eyelets 58 to provide a complete hinge assembly which eventually lies beyond the reach of an intruder or vandal. This feature increases the security of the unit. FIG. 7A illustrates the details of the configuration and placement of the closed, front frame hinge eyelet 70 in relation to the right side wall section 94. A similar construction is provided on the opposite, left side wall section 92 of the front frame 12.

Figure 8:
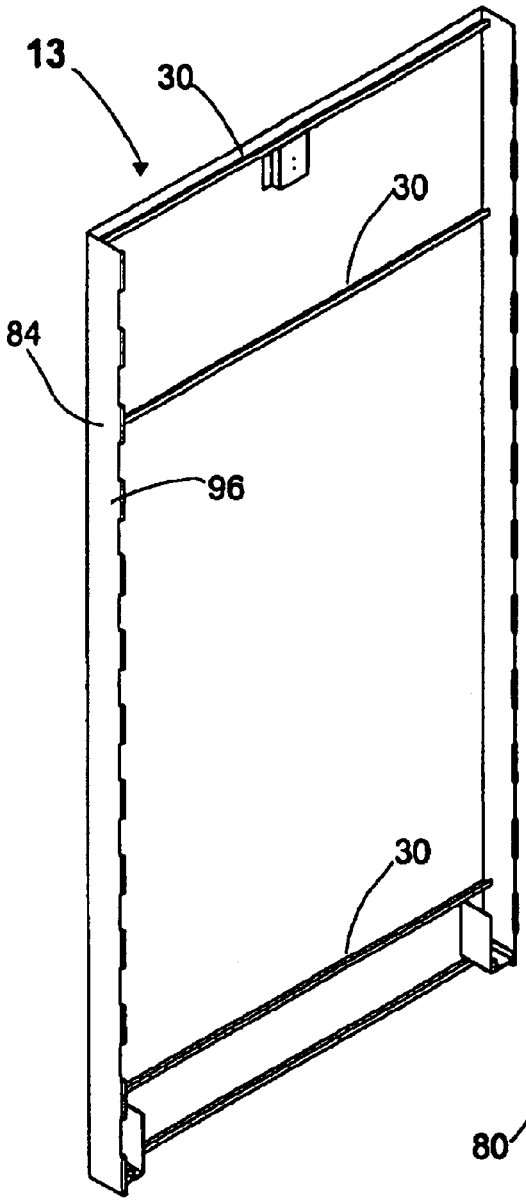
FIG. 8 illustrates a front perspective view of the rear frame assembly of the present invention.
Figure 8A:
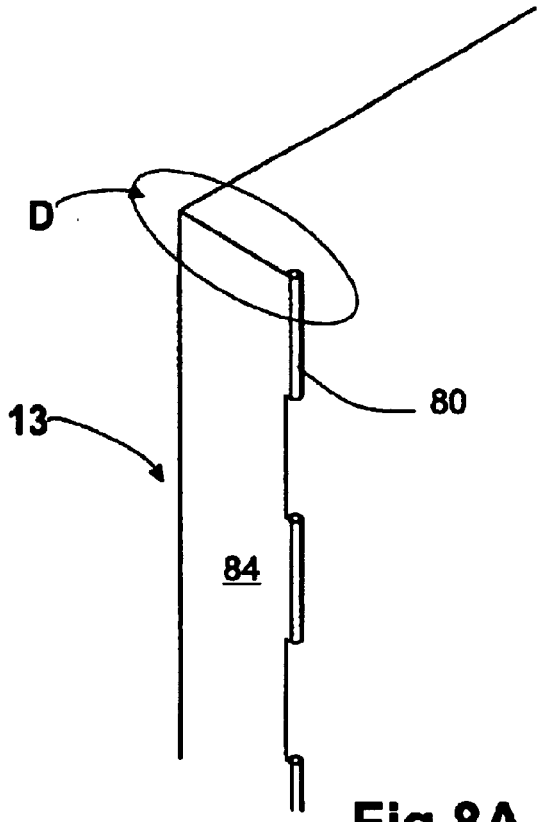
FIG. 8A depicts a detailed right side perspective view of a portion of the rear frame assembly of the present invention showing the rear hinge eyelets extending inwardly toward the inner space of the unit and frontwardly toward the front frame assembly.
Figure 8B:
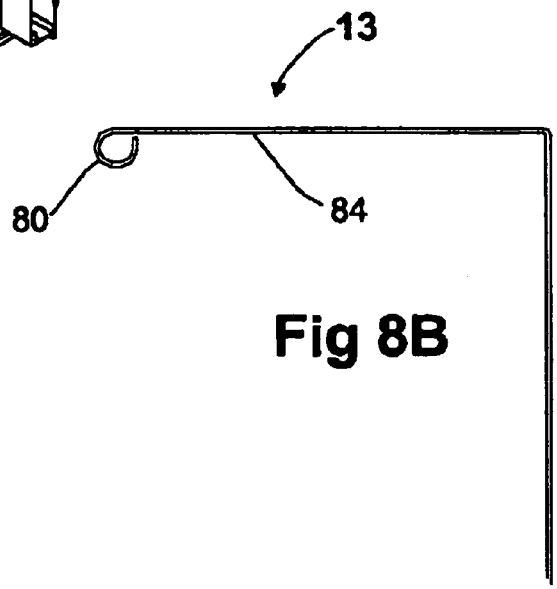
FIG. 8B is a top plan view of a portion of the left side of the rear frame assembly illustrating the placement of the hinge eyelet on the side section of the rear frame.

FIG. 8 is a perspective illustration of the rear frame assembly 13 showing the frontwardly extending hinge arms 96 which have the closed eyelets 80 bent or pressed inwardly at the distal end of the arm for cooperative engagement with the rear side panel edge eyelets 61 discussed above. As with the front frame eyelet/front side panel edge eyelet connection, this rear connection of the hinge assembly provides for increased security of the hinge and the entire wardrobe. FIG. 8A shows the details of the hinge eyelet 80 on the side wall section 84 of the rear frame 12. FIG. 8B illustrates the details of the hinge arm/hinge eyelet construction. The inward closure of the eyelet should be noted. While the above discussion relates to one side of the rear frame, it should be understood that the opposite side wall section is similarly constructed.

Figure 9:
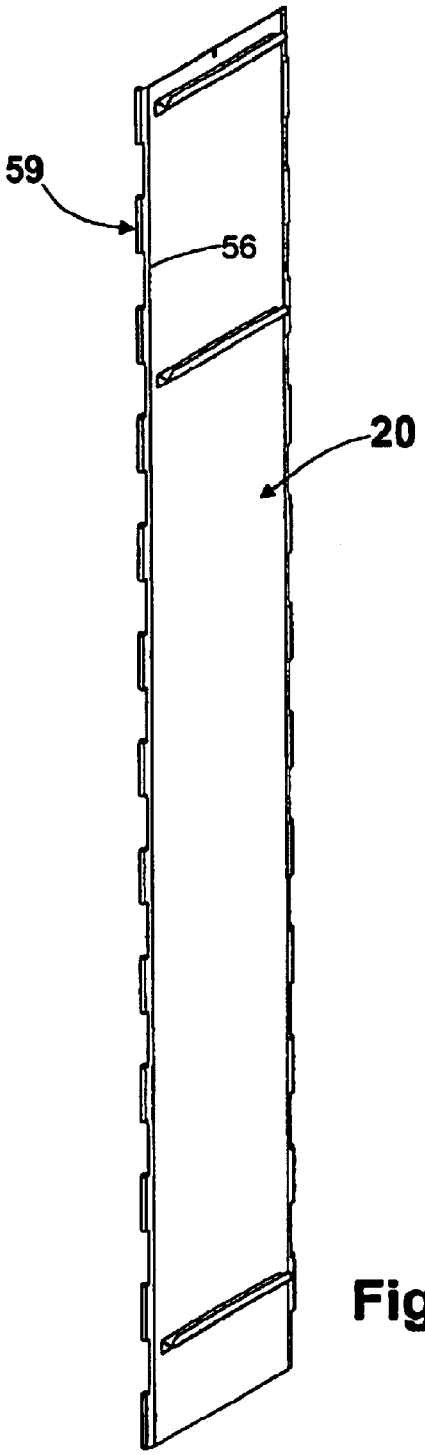
FIG. 9 is an inner side perspective view of one of the side panel sections of the present invention illustrating the arrangement of the hinge eyelets along the outer edges of the panel with the closed eyelets extending outwardly from the stiffener section of the hinge arm. Also illustrated are the top, central, and bottom shelf channels.
Figure 9A:
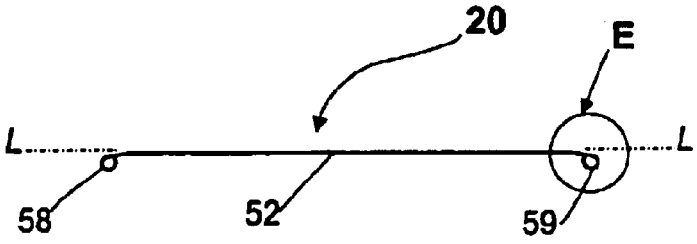
FIG. 9A is a top plan view of a side panel section showing the lateral axis of the panel and the offset angle of the eyelets extending outwardly from the panel wall.
Figure 9B:
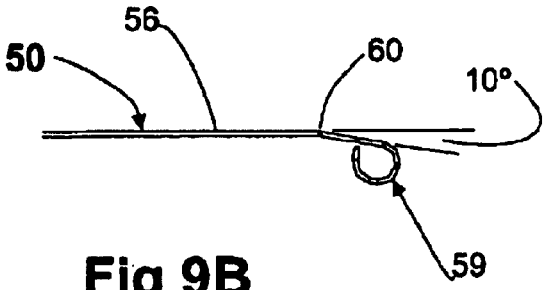
FIG. 9B is a detailed view of the closed side panel eyelet circled in FIG. 9A.

Turning to FIGS. 9A and 9B, a side panel section is illustrated in a top plan view. It should be understood that the panel section 20 shown is the same structural construction as the other left and right, front and rear side panels discussed throughout. Panel 20 is a unitary sheet metal construction with the hinge arms 56 extending from one side panel edge and from a second side panel connection edge. FIG. 9B shows the details of the offset hinge eyelet 59 circled E in FIG. 9A. This offset angle provides a stiffening effect in the hinge to give improved security strength, and integrity of the assembled hinge not achieved in any prior art units. While a 10° angle is preferred, it is anticipated that an offset angle in the range of 5°–45° may be acceptable to act as a stiffener for the hinge arms.

Figure 10:
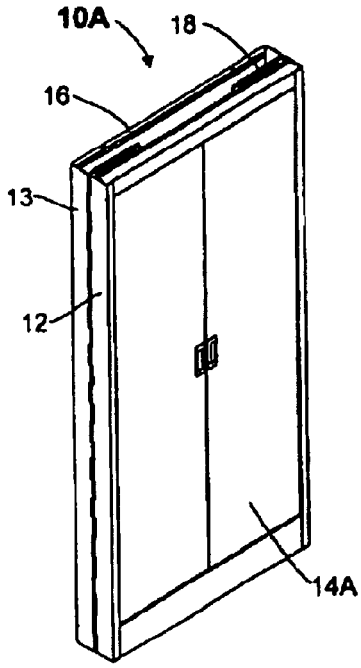
FIG. 10 is a perspective view of another embodiment of the present invention in the folded or collapsed position with the top hinge inside the unit on the top shelf channel.
Figure 11:
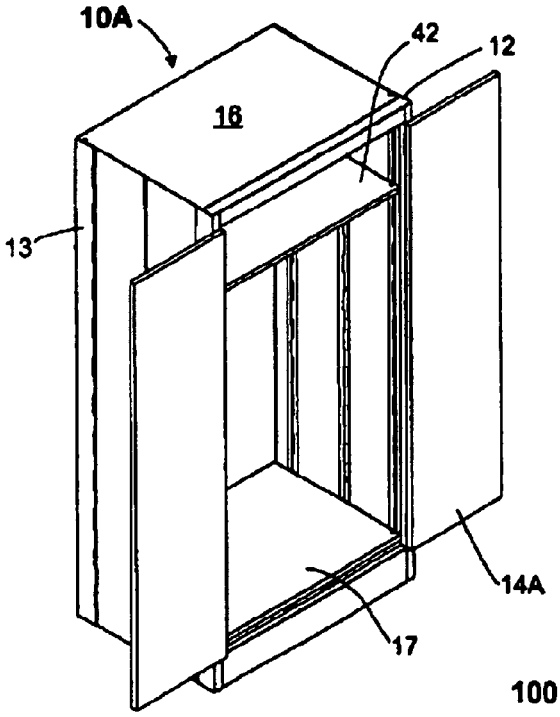
FIG. 11 illustrates a front perspective view of the embodiment of FIG. 10 in the open or unfolded position with the closure doors open revealing the inner space of the unit with the control shelf and the bottom in position in the open configuration.
Figure 12:
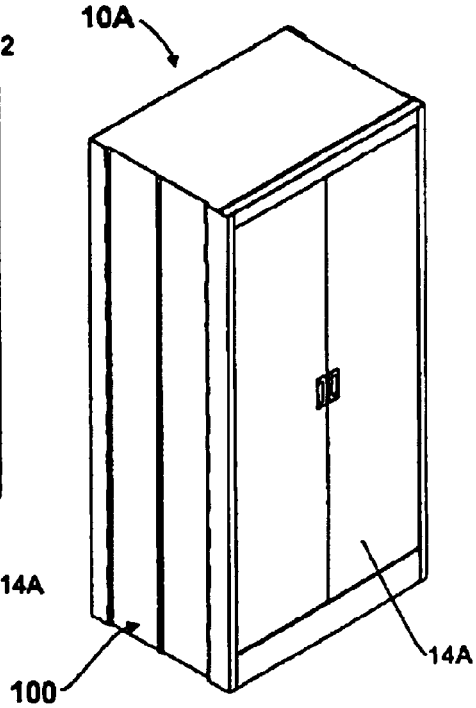
FIG. 12 shows the embodiment of FIG. 10 in the fully open or unfolded position with the closure doors closed and secured.

FIGS. 10 through 12 illustrate another embodiment 10A of the present wardrobe with a different style of closure door 14A. Overall the construction and elements of embodiment 10A are the same as embodiment 10. FIG. 10 shows the unit in the folded or collapsed position. The top is attached to the inner top shelf channel while the central shelf or panel and the bottom or floor panels are similarly stored inside the folded unit.

FIG. 11 shows the unit 10A in the open or unfolded position with the closure doors 14A open to reveal the central shelf 42 attached to the shelf channel on the rear frame and the folding side panels. FIG. 12 illustrates the unit 10A with the doors 14A closed. Also, FIG. 12 shows that the right side foldable side wall 100 is similarly constructed to the left side wall described above.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

What is claimed is:

1. A foldable sheet metal wardrobe having a front wall, a rear wall, a foldable right side wall, a foldable left side wall, a top member, and a bottom member defining an inner wardrobe space when said wardrobe is in an open position, said wardrobe comprising:

a left and a right unitary front side panel, each of said unitary front side panels having a first section of a closed loop hinge assembly integrally formed in the sheet metal of said front side panel, said first integral hinge section having an offset stiffener member; and a left and right unitary rear side panel, each of said unitary rear side panels having a second, complimentary closed loop hinge assembly section integrally formed in the sheet metal of said rear side panels, said second integral hinge section having an offset stiffener member, each said front side and said rear side panels connected along said first and second sections by a single continuous steel hinge pin to join said sections into single foldable left and right hinged side walls.

2. The foldable sheet metal wardrobe of claim 1, wherein said front wall comprises a door having a single latch handle.

3. The foldable sheet metal wardrobe of claim 1, wherein said front wall comprises a door having a set of door pulls.

4. A folding sheet metal wardrobe comprising:

a front frame and a rear frame, said front frame having an inner surface, an outer surface, a right side, a left side, and a plurality of spaced apart front frame hinge arms extending rearwardly from said right and left sides of said front frame, each of said front frame hinge arms having a front frame hinge eyelet integrally formed in the sheet metal of said front frame along an inner surface of and at a distal end of said front frame hinge arms;

said rear frame having an inner surface, an outer surface, a right side, a left side, and a plurality of spaced apart rear frame hinge arms extending frontwardly from said right and left sides of said rear frame, each of said rear frame hinge arms having a rear frame hinge eyelet integrally formed in the sheet metal of said rear frame along an inner surface of and at a distal end of said rear frame hinge arms;

a left and a right front unitary side panel, each of said front side panels having an inner surface and an outer surface, a front side panel edge, a front side panel midsection, a front side panel connection edge, and a plurality of cooperating front side panel hinge arms extending from said front side panel edge and said front side panel connection edge, said front side panel midsection disposed along a first lateral axis, each of said front side panel hinge arms extending from said front side panel edge having a front side panel edge closed hinge eyelet integrally formed in the sheet metal of said front side panels along said outer surface and extending outwardly from said first lateral axis on a front side panel edge stiffener at a first offset angle, each of said front side panel hinge arms extending from said front side panel connection edge having a front side panel connection edge closed hinge eyelet integrally formed in the sheet metal of said front side panels along said outer surface and extending outwardly from said first lateral axis on a front side panel connection edge stiffener at a second offset angle, said left and right front side panels hingedly attached at said front side panel edge closed hinge eyelets to said front frame hinge eyelets;

a left and a right rear side panel, each of said rear side panels having an inner surface and an outer surface, a rear side panel edge a rear side panel midsection, a rear side panel connection edge, and a plurality of cooperating rear side panel hinge arms extending from said rear side panel edge and said rear side panel connection edge, said rear side panel midsection disposed along a second lateral axis, each of said rear side panel hinge arms extending from said rear side panel edge having a rear side panel edge closed hinge eyelet integrally formed in the sheet metal of said rear side panels along said outer surface and extending outwardly from said second lateral axis on a rear side panel edge stiffener at a third offset angle, each of said rear side panel hinge arms extending from said rear side panel connection edge having a rear side panel connection edge closed hinge eyelet integrally formed in the sheet metal of said rear side panels along said outer surface and extending outwardly from said second lateral axis on a rear side panel connection edge stiffener at a fourth offset angle, said left and right rear side panels hingedly attached by a single continuous steel hinge pin at said rear side panel edge closed hinge eyelets to said rear frame hinge eyelets and further hingedly attached by a single continuous steel hinge pin at said rear side panel connection edge closed hinge eyelets to said front side panel connection edge closed hinge eyelets;

whereby said wardrobe is foldable from a first collapsed position to a second open position about said front frame hinge eyelets, said front side panel edge closed hinge eyelets, said front side panel connection edge closed hinge eyelets, said rear side panel connection edge closed hinge eyelets, said rear side panel edge closed hinge eyelets, and said rear frame hinge eyelets.

5. A foldable sheet metal wardrobe having a front, a rear, a foldable right side, a foldable left side, a top, and a bottom defining an inner wardrobe space when said wardrobe is in an open position, said wardrobe comprising:

a front frame having left and right side sections with front frame hinge eyelets integrally formed in the sheet metal of said front frame, said front frame hinge eyelets extending inwardly and rearwardly when said wardrobe is in said open position;

a rear frame having left and right side sections with rear frame hinge eyelets integrally formed in the sheet metal of said rear frame, said rear frame hinge eyelets extending inwardly and frontwardly when said wardrobe is in said open position;

a left and a right unitary front side panel, each said unitary front side panel having a first lateral axis and integrally formed in the sheet metal of said front side panels a front side panel edge and front side panel connection edge hinge eyelets extending outwardly from said first lateral axis on front side panel stiffener members at an offset angle, said front side panel front edge eyelets hingedly attached to said front frame hinge eyelets; and a left and a right unitary rear side panel, each said unitary rear side panel having a second lateral axis and integrally formed in the sheet metal of said rear side panels a rear side panel edge and rear side panel connection edge hinge eyelets extending outwardly from said second lateral axis on rear side panel stiffener members at said offset angle, said rear side panel rear edge hinge eyelets hingedly connected to said rear frame hinge eyelets and said rear side panel connection edge hinge eyelets hingedly connected to said front side panel connection edge hinge eyelets by a single continuous steel hinge pin to join said front side and rear side panels into single foldable left and right side walls.

6. The foldable wardrobe of claim 5 wherein said offset angle is approximately 10° from said first and second lateral axes.

* * * * *